US007907884B2

(12) United States Patent
Morita

(10) Patent No.: US 7,907,884 B2
(45) Date of Patent: Mar. 15, 2011

(54) CLEANING MEMBER AND IMAGE FORMING APPARATUS

(75) Inventor: Sayaka Morita, Gamagoori (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 17 days.

(21) Appl. No.: 11/785,104

(22) Filed: Apr. 13, 2007

(65) Prior Publication Data

US 2007/0242991 A1 Oct. 18, 2007

(30) Foreign Application Priority Data

Apr. 14, 2006 (JP) ..... 2006-112102

(51) Int. Cl.
*G03G 21/00* (2006.01)

(52) U.S. Cl. ..... 399/350

(58) Field of Classification Search ..... 399/350
See application file for complete search history.

(56) References Cited

U.S. PATENT DOCUMENTS 3,660,863 A * 5/1972 Gerbasi ..... 399/351
3,789,451 A * 2/1974 Laitner ..... 15/118
4,264,182 A * 4/1981 Mitchell ..... 399/164
5,991,568 A * 11/1999 Ziegelmuller et al. ..... 399/102
2004/0170455 A1 * 9/2004 Shintani et al. ..... 399/350

FOREIGN PATENT DOCUMENTS

| | | |
|---|---|---|
| JP | 62-058472 | 4/1987 |
| JP | 08-095449 | 4/1996 |
| JP | 08-123273 | 5/1996 |
| JP | 2001-051565 A | 2/2001 |
| JP | 2005-321577 | 11/2005 |

* cited by examiner

*Primary Examiner* — David M Gray
*Assistant Examiner* — Barnabas T Fekete
(74) *Attorney, Agent, or Firm* — Morrison & Foerster LLP

(57) ABSTRACT

A cleaning member is elastically forced on a bearing surface, for cleaning off particles from the bearing surface by a movement of the bearing surface relative to the cleaning member. In particular, the cleaning member has first and second portions capable of forming first and second ramps having first and second acute internal angles on upstream and downstream sides of a contact region with respect to a moving direction of the bearing surface, respectively, the contact region being defined between the cleaning member and the bearing surface when the cleaning member is forced on the bearing surface.

12 Claims, 6 Drawing Sheets

CLEANING MEMBER AND IMAGE FORMING APPARATUS

RELATED APPLICATION

This application is base on patent application No. 2006-112102 filed in Japan, the entire content of which is hereby incorporated by reference.

FIELD OF THE INVENTION

The present invention relates to a cleaning member preferably used for cleaning off toner particles remaining on a bearing surface of an image bearing member such as photosensitive drum in an electrophotographic image forming apparatus. Also the present invention relates to an image forming apparatus including that cleaning member.

BACKGROUND OF THE INVENTION

A conventional electrophotographic image forming apparatus has an image bearing member such as photosensitive drum. The image bearing member supports a toner powder image made through a visualization of an electrostatic latent image by the use of toner particles. The toner powder image is then transferred to a medium such as paper. In this transfer operation, not all the toner particles are transferred onto the medium and a small number of particles stay untransferred on the image bearing member. The untransferred toner particles are then removed from the image bearing member by a cleaning member.

JP 2001-51565 A discloses a cleaning member in the form of blade. As illustrated in FIG. 7, a blade cleaning needs a formation of wedge-like static mass of powder 500 in a triangle zone defined by the surface of the image bearing surface 502 and the blade 504 on the upstream side of the contact region 506 with respect to the moving direction 508 of the image bearing surface 502. The static mass of powder 506, which includes small fragments of toner particles T and additives mixed with or added into the toner, prevents toner particles from moving into the contact region where they can be adhered onto the image bearing surface 502. A part of the mass, i.e., a small amount of toner fragments and additives, flows out of the mass through between the image bearing surface 504 and the opposed blade 502. The loss is compensated by new fragments and additives to be transported by the image bearing surface 504, which results in that the amount of the mass is maintained substantially constant. The amount of toner fragments and additives flowing out of the mass can be controlled by the appropriate selection of the material of the blade 504 and/or adjusting the contact force of the blade 504 against the image bearing surface 502. As discussed above, the mass favorably and effectively prevents the toner particles from passing through the contact region and then scattering into the air which would cause a contamination of the apparatus.

The size of the mass, i.e., the amount of toner fragments and additives forming the mass, can be changed according to the conditions of image formations, for example, the amount of toner particles used for the development of the electrostatic latent image. This results in the change of size of the mass. In particular, the use of toner with less additives and/or the use of smaller toner particles tends to change the size of the mass, which fails to ensure a stable cleaning of the toner particles from the image bearing surface and then causes an unwanted aggregation of the toner particles within the triangle zone which would flow out through the contact region.

SUMMARY OF THE INVENTION

Accordingly, an object of the present invention is to provide a cleaning member capable of cleaning off toner particles from the image bearing surface in a stable manner, irrespective of the types of toner and the conditions of image formation. Another object of the present invention is to provide an image forming apparatus including such cleaning member.

The cleaning member is elastically forced on a bearing surface, for cleaning off particles from the bearing surface by a movement of the bearing surface relative to the cleaning member. In particular, the cleaning member has first and second portions capable of forming first and second ramps having first and second acute internal angles on upstream and downstream sides of a contact region with respect to a moving direction of the bearing surface, respectively, the contact region being defined between the cleaning member and the bearing surface when the cleaning member is forced on the bearing surface.

According to the present invention, the ramp on the upstream side scrapes off particles on the bearing member in a stable and effective manner.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following descriptions of the preferred embodiments are merely exemplary in nature and are in no way intended to limit the invention, its application, or uses.

Figure 1:
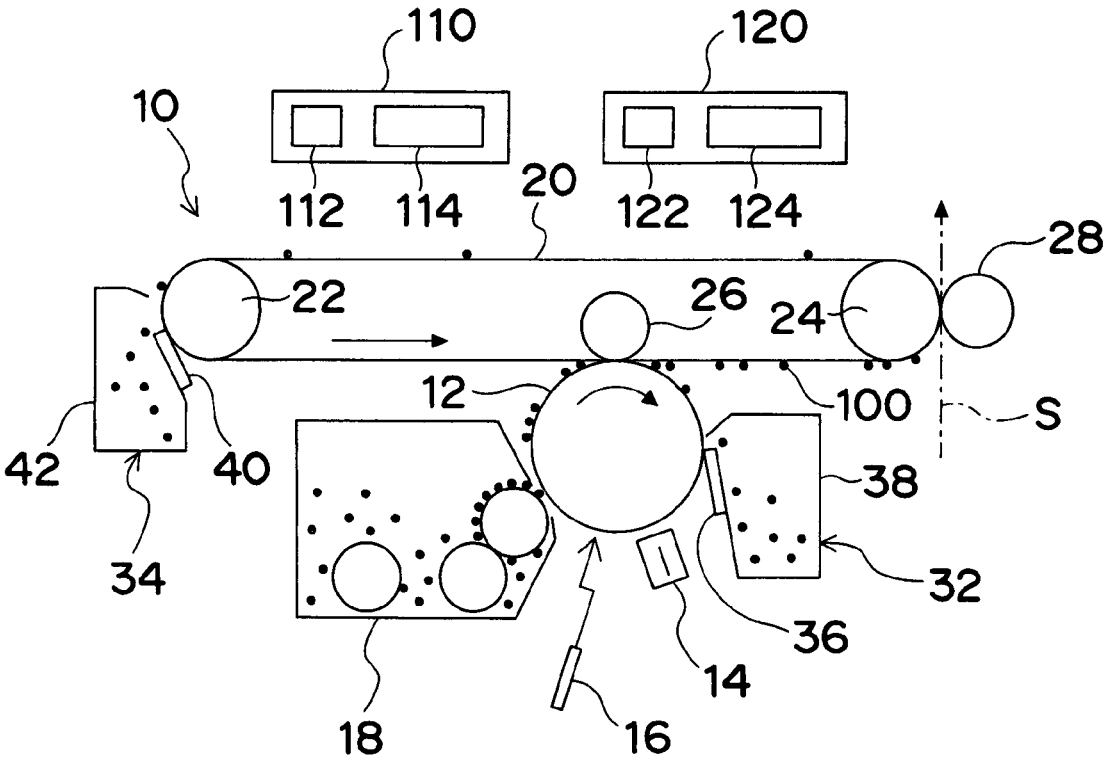
FIG. 1 is a diagram schematically showing components of the image forming apparatus according to the present invention.

FIG. 1 schematically shows structural components mounted within an image forming apparatus, generally indicated by reference numeral 10, such as a copy machine, a printing machine, a faxing machine and a complex machine including copying, printing and faxing functions.

The structural components of the image forming apparatus 10 will be discussed briefly together with the operations thereof. The image forming apparatus 10 includes an image bearing member or photosensitive drum 12 in the form of cylinder having an outer peripheral image bearing surface. The drum 12, which is drivingly coupled to a drive unit 110, is rotated in the clockwise direction. During the rotation of the drum 12, the image bearing surface of the drum 12 is electrically charged evenly by a charging device 14. The charged image bearing surface of the drum 12 is exposed to image light projected from an image projection device 16 to form an electrostatic latent image thereon. The electrostatic latent image is then developed by a developing device 18 by the use of toner made of toner particles into a toner powder image. The toner image is transferred onto a receiving medium or an intermediate transfer belt 20 at a first transfer region. The transfer belt 20 is entrained around a plurality of rollers including rollers 22 and 24 so that it faces the drum 12 at the first transfer region. Either one of the two rollers 22 and 24 is drivingly coupled to a drive unit 120 so that the transfer belt 20 is circulated in the counterclockwise direction. The transfer of the toner from the drum 12 onto the belt 20 is attained by the aid of a transferring device 26 mounted inside the belt 20 and closely opposed to the drum 12 at the first transfer region. The toner image on the belt 20 is transported by the movement of the belt 20 into a second transfer region where a second transfer device 28 is provided to face the outer peripheral surface of the belt 20, so that the toner image is transferred onto a receiving medium such as a sheet S passing between the belt 20 and the transfer device 28. Although not shown, the sheet S is then transported into a fixing device where the toner image is fused and fixed onto the sheet S. Finally, the sheet S bearing the fixed image is transported to a discharge tray or a finishing device where it is sorted.

Although most of the toner particles on the drum 12 are transferred onto the belt 20, part of toner particles remain on the drum 12 without being transferred onto the belt 20. Likewise, although most of the toner particles on the belt 20 are transferred onto the sheet S, part of the toner particles remain on the belt 20 without being transferred onto the sheet S. In order to remove the untransferred toner particles from the drum 12 and the belt 20, the image forming apparatus includes first and second cleaning device 32 and 34 for cleaning off toner particles from the drum 12 and belt 20, respectively. The cleaning device 32 has a cleaning member 36 in the form of blade for scraping off toner particles from the image bearing surface of the drum 12 and a container 38 for receiving the scraped off toner particles. Likewise, the cleaning device 34 has a cleaning member 40 in the form of blade for scraping off toner particles from the image bearing surface of the belt 20 and a container 42 for receiving the scraped off toner particles. The structures of the cleaning members 36 and 40 will be discussed in great details in the later discussions.

The drive unit 110 for the drum 12 has a rotational drive source 112 such as a motor drivingly coupled with the drum 12 and a control means or drive control 114 for controlling the drive source 112. The drive control 114 controls the drive source 112 so that the drum 12 rotates in the forward direction, i.e., clockwise direction in the image forming operation described above and rotates in the backward direction, i.e., counterclockwise direction in a recovering operation of the cleaning member 36 which will be described later. Likewise, the drive unit 120 for the belt 20 has a rotational drive source 122 such as a motor drivingly coupled with the roller 22 or 24 and a control means or drive control 124 for controlling the drive source 122. The drive control 124 controls the drive source 122 so that the belt 20 rotates in the forward direction, i.e., counterclockwise direction in the image forming operation described above and rotates in the backward direction, i.e., clockwise direction in a recovering operation of the cleaning member 40 which will be described later.

Discussions will be made in detail to the cleaning members 36 and 40 of the cleaning devices 32 and 34. The cleaning members 36 and 40 are used for cleaning off toner particles from different members, i.e., drum 12 and belt 20, made of different materials and in different configurations. Therefore, they may be positioned in difference angles with respect to the image bearing surfaces of the drum 12 and the belt 20 and/or may be set to contact with the drum 12 and belt 20 with different contact forces. The cleaning members 36 and 40, however, have substantially the same basic structure and attain substantially the same function in scraping off toner particles.

Figure 2:
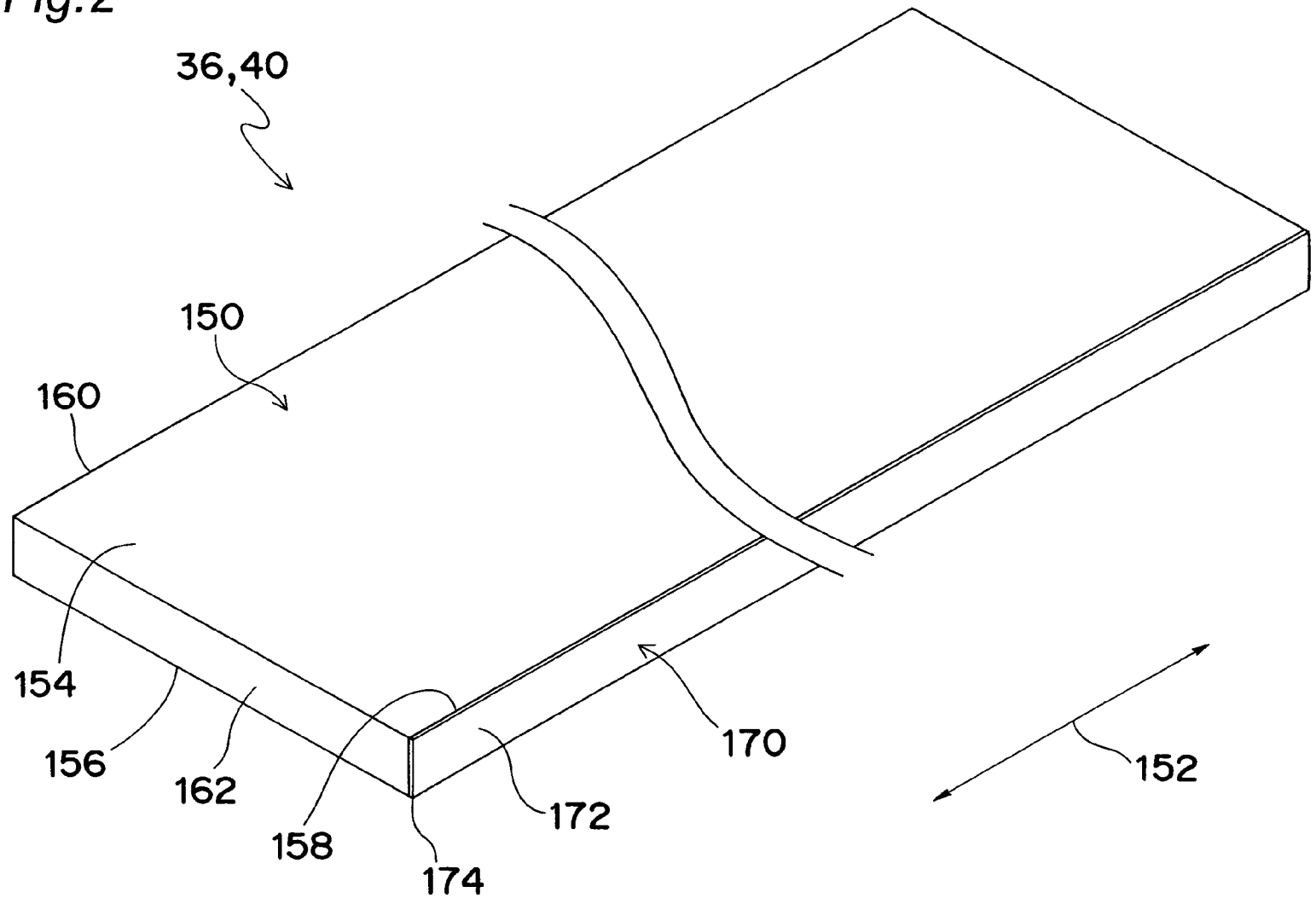
FIG. 2 is a partial enlarged perspective view of a cleaning member according to the present invention.
Figure 3:
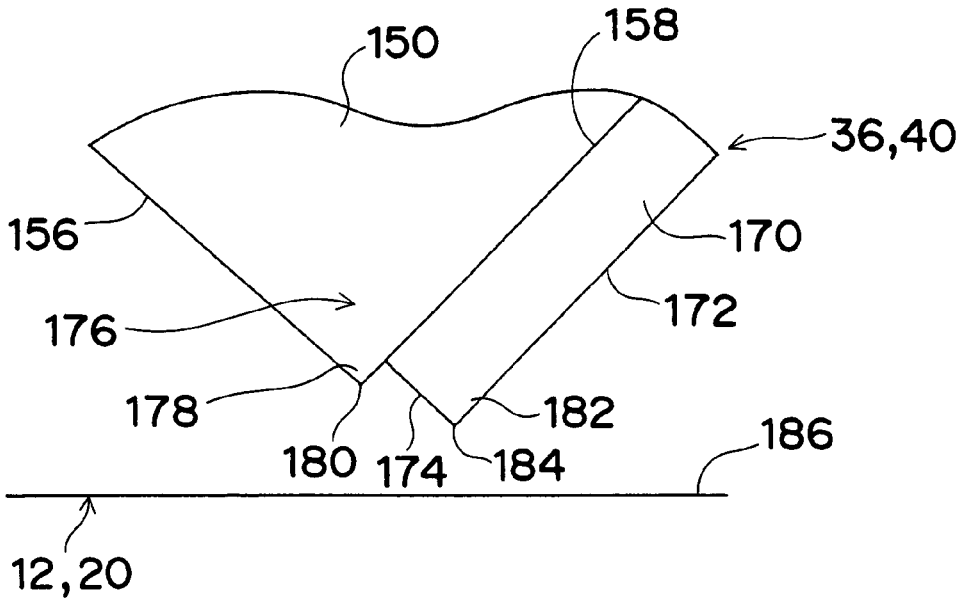
FIG. 3 is a partial enlarged side elevational view showing a contact portion of the cleaning device which is not forced to the image bearing member.

FIG. 2 is an enlarged perspective view of the cleaning members 36 and 40 and FIG. 3 is an enlarged side elevational view of the corner of cleaning members 36 and 40.

Each of the cleaning members 36 and 40 has a substrate 150 in the form of elongated rectangular plate extending in the direction parallel to the central axis 152 of the drum 12. The plate, which is preferably made of elastic material, has a pair of opposed major surfaces 154 and 156, a pair of opposed longitudinal side surfaces 158 and 160, and a pair of end surfaces 162 and 164. Preferably, the plate has a thickness of about 0.5 to 10 mm.

The longitudinal side surface 158 of the substrate 150, which would be placed adjacent image bearing member 12, 20, supports an elastic layer 170. The elastic layer 170, which is made of elastic material, is mounted on substantially the entire portion of the surface 158. Preferably, the elastic layer 170 has a thickness of about 50 to 500 μm. As indicated in FIG. 3, the elastic layer 170 has a major surface 172 away from the side surface 158 of the substrate 150 and a longitudinal side surface 174.

As best shown in FIG. 3, a contact portion 176, which will be brought into contact with the image bearing surface, is defined by a contact sub-portion (second sub-portion) 178 of the substrate 150 including a longitudinal corner edge 180 defined between the major surface 156 and the longitudinal side surface 158 and a contact sub-portion 182 of the elastic layer 170 including a longitudinal corner edge 184 between the major surface 172 and the side surface 174. Preferably, as best shown in FIG. 3, the corner edge 184 of the elastic layer 170 is positioned slightly away from the corner edge 180 of the substrate 150.

Figure 4:
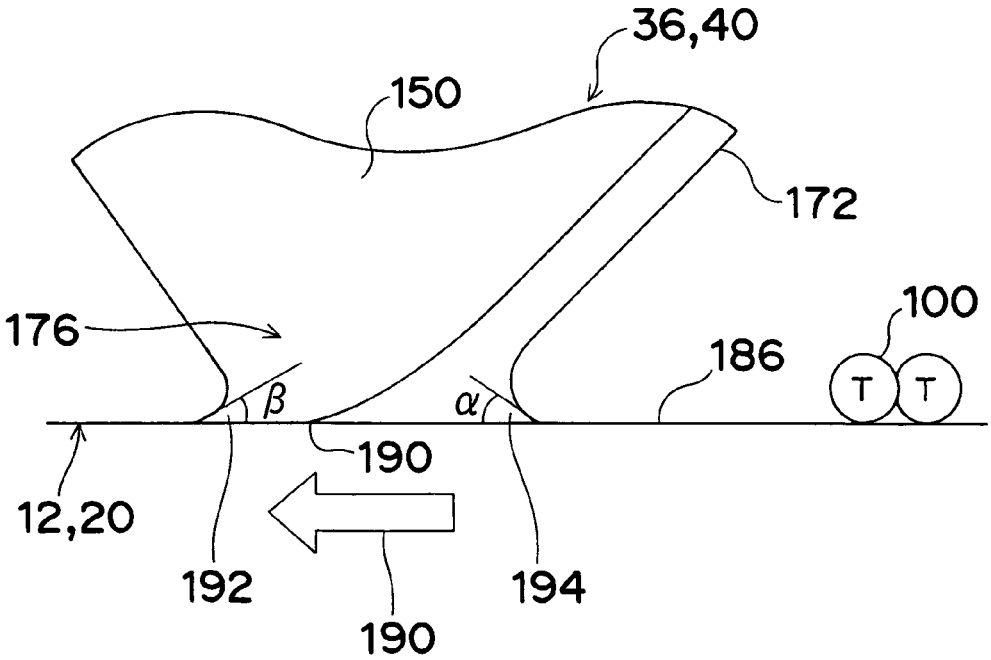
FIG. 4 is a partial enlarged side elevational view showing the contact portion of the cleaning device which is forced to the image bearing member.

FIG. 4 shows a part of the cleaning member 36, 40 in which the cleaning member is inclined to the image bearing surface 186 of the image bearing member 12, 20 and the contact portion 176, in particular, the surface portions extending between the corner edges 180 and 184, is forced onto the image bearing surface with the major surface 172 of the elastic layer 170 positioned on the upstream side of the moving direction 188 of the image bearing member 36,40 and with the major surface 156 of the substrate 150 positioned on the downstream side of the moving direction 188, causing the resiliently deformed contact portion 176 to form a contact region 190. The cleaning member 36, 40 is fixedly supported by, for example, the container 38,42, so that the deformed corner edge 180 of the substrate 150 defines a ramp (second ramp) 192 with an acute internal angle (contact angle) β on the downstream side of the contact region 190 with respect to the moving direction 188 of the image bearing member 186 and also the deformed corner edge 184 of the elastic layer 170 defines a ramp (first ramp) 194 with an acute internal angle α on the upstream side of the contact region 190.

In cleaning operation, the residual toner particles 100 on the image bearing surface 186 of the image bearing member 12, 20 are transported in the direction of arrow 190 to reach the deformed contact portion 176 where the toner particles 100 are scraped or cleaned off by the ramp 194 of the elastic layer 170 and away from the image bearing surface 186. The scraped toner particles 100 are then received by the container 32, 42.

Figure 7:
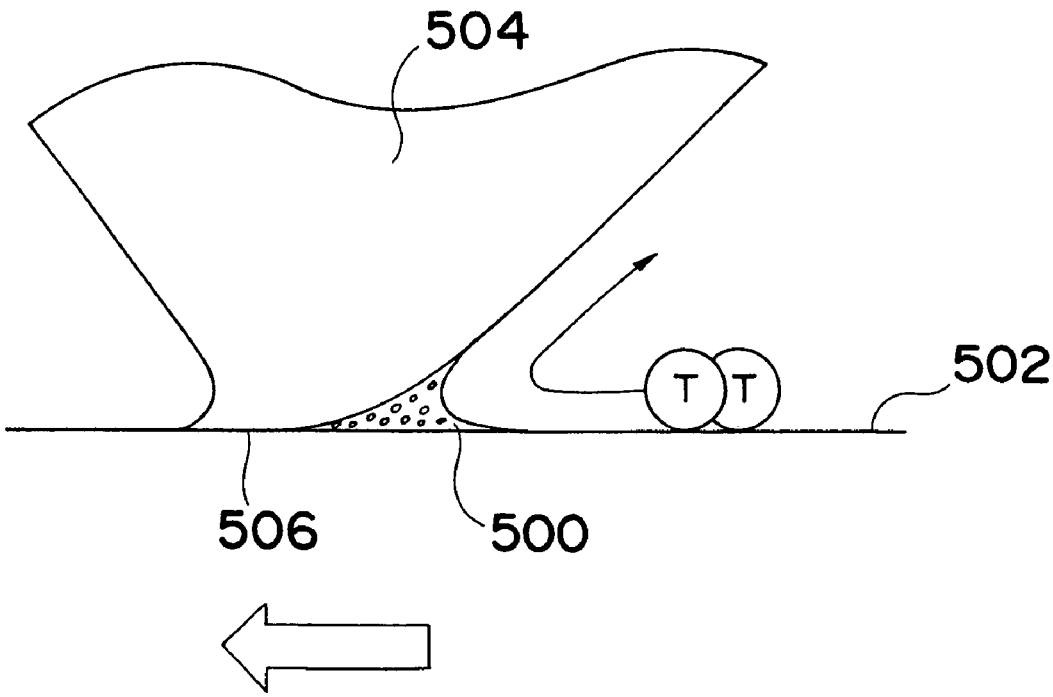
FIG. 7 is a partial enlarged side elevational view of the conventional cleaning member which forms a mass of powder on the upstream side of the cleaning member.

As described above, the ramp 194 acts as the particle mass formed at the triangle area between the image bearing surface and the cleaning member as indicated in FIG. 7, which ensures that the toner particles are effectively scraped off from the image bearing member.

To maintain the acute angles α and β of the ramps 192 and 194 on the upstream and downstream sides of the contact region, respectively, with respect to the moving direction of the image bearing member even at the rotation of the image bearing member 56, the materials of the substrate 150 and the elastic layer 170 should be appropriately selected from among elastic materials such as isoprene rubber, butadiene rubber, butyl-rubber, ethylene-propylene rubber, chloroprene rubber, epichlorohydrin rubber, acrylic rubber, urethane rubber, silicon rubber, fluorocarbon rubber, styrene-butadiene rubber, chlorosulfonated polyethylene, chlorinated polyethylene, nitrile rubber and polysulfide rubber.

Figure 5:
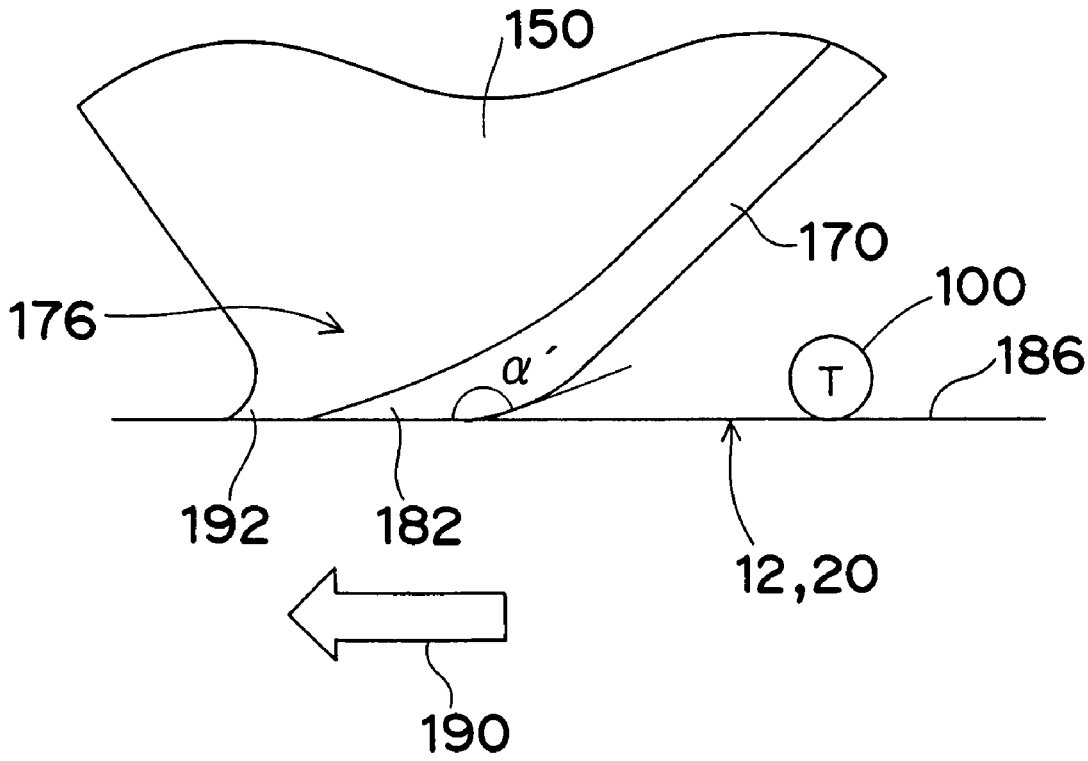
FIG. 5 is a partial enlarged side elevational view of showing the upstream ramp is flipped over into the contact region between the cleaning member and the image bearing member.

Preferably, the material of the elastic layer 170 has smaller hardness and static friction coefficient than the substrate 150. Otherwise, ramp 194 of the elastic layer 170 might be drawn into the contact region by the frictional contact with the moving image bearing surface 186 and disappear so that the elastic layer 170 defines instead an obtuse internal angle α' as illustrated in FIG. 5. The end portion of the elastic layer 170 with the obtuse internal angle α' is evidently unable to scrape off toner particles 100, in turn allowing the toner particles 100 to flow into the contact region 190 between the contact portion 176 and the image bearing surface 186.

The inventor of the present invention conducted experiments to confirm the fact that the elastic layer 170 of the cleaning member 36,40 favorably scrapes off toner particles from the image bearing surface 186. The experiments were conducted using the cleaning member with the elastic layer and the cleaning member without the elastic layer. In the experiments, the cleaning abilities were evaluated for respective line pressures between the cleaning members and the photosensitive member by measuring the amounts of toner scraped off from the image bearing surface by the cleaning members.

Each substrate of the cleaning members was made of urethane rubber and was sized to have a longitudinal length of 250 mm, a width of 15 mm, and a thickness of 2 mm. The elastic layer was made of silicon rubber having a thickness of about 50 μm. The hardness, i.e., durometer hardness, of the substrates and the elastic layer was measured in accordance with a measurement method JIS K6253, in an environment at 25 degrees Celsius and at 60% relative humidity. The measurements showed that the substrate had a hardness of A70. Also confirmed was that the elastic layer had a smaller hardness than the substrate. The static friction coefficients of the substrates and the elastic layer against hard chromium treated brass with a weight of 40 g was measured in accordance with a measurement method JIS K7125 in an environment at 25 degrees Celsius and at 60% relative humidity. The measurements showed that the static friction coefficient of the substrates was 0.9, while that of the elastic layer was less than 0.4.

The photosensitive drum was used for the image bearing member, with the image bearing surface made of low-friction material polytetrafluoroethylene (PTFE). The line pressures between the cleaning members and the image bearing surface were set to 10 N/m and 20 N/m.

To ensure the reliability of the results, the same amounts of toner of the same type with minimum additives was used for respective cleaning members. The cleaning ability of each cleaning member was evaluated in terms of the amount of toner the cleaning member scraped off. The result is shown in the following Table 1.

TABLE 1

| Cleaning Ability | | |
|---|---|---|
| | Line Pressure | |
| | 20 N/m | 10 N/m |
| Cleaning Member with Elastic Layer | Favorable | Favorable |
| Cleaning Member without Elastic Layer | Unfavorable but Tolerable | Unfavorable and Intolerable |

As can be seen from the Table, the cleaning ability of the cleaning member with the elastic layer was favorable irrespective of the line pressure. In contrast, the cleaning ability of the cleaning member without the elastic layer was increased with the increase of the line pressure but less than that of the cleaning member with the elastic layer at respective line pressures. Evidently, the result indicates that the elastic layer fairly contributes to the improvement of the cleaning ability, i.e., toner scraping ability.

As shown in FIG. 3, the elastic layer 170 is so positioned that the corner edge 184 of the elastic layer 170 stays back from the corner edge 180 of the substrate 150. This arrangement may be attained by the conventional ways such as cutting off the longitudinal end of the elastic member or molding the elastic layer on the substrate, however, the inventor of the present invention discovered a favorable method for forming the elastic layer 170, which will be discussed below.

Figure 6A:
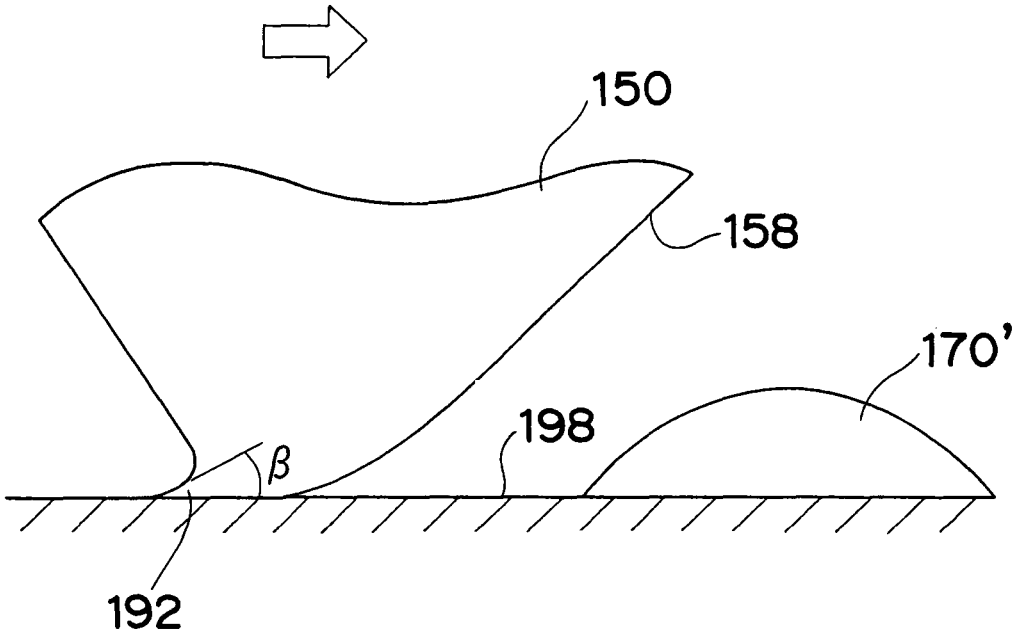
FIGS. 6A and 6B are diagrams showing a method for forming the elastic layer on the substrate.
Figure 6B:
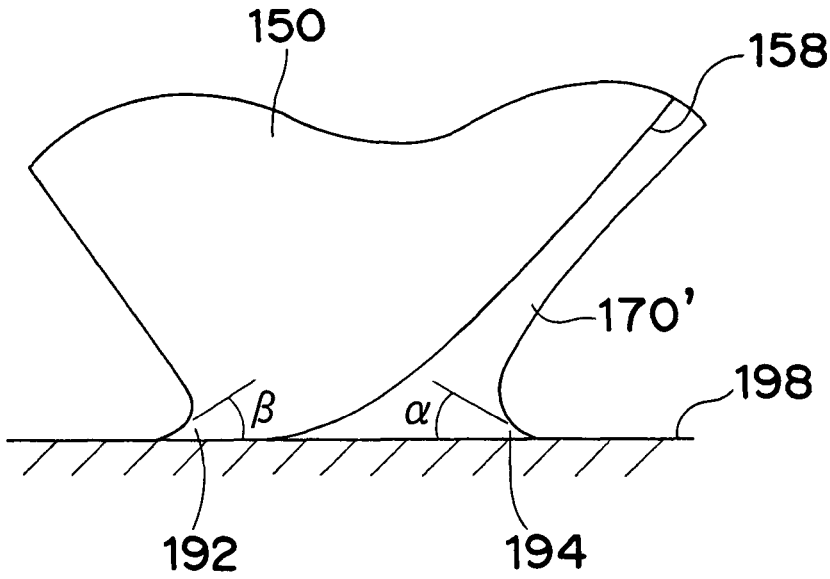

Discussions will be made to a relatively simple method for forming the elastic layer on the substrate while leaving the sub-portion 178 of the substrate 150 uncovered by the sub-portion 182 of the elastic layer 170. According to this method, as shown in FIG. 6A, an elastic material 170' in the form of liquid is applied on a flat and smooth plate 198. Preferably, the plate 198 has a wettability to the elastic material so that the contact angle of the liquid elastic material to the plate is an acute angle equal to or substantially equal to the acute internal angle α. The longitudinal corner edge 180 of the substrate 150 is forced onto the plate 198 so that it forms the ramp 192 with the acute internal angle β. The substrate 150 is slidingly and wipingly moved on the plate 198 while maintaining the deformation of the substrate 150, so that the exposed longitudinal surface 158 of substrate 150 comes into contact with the elastic material 170'. This results in that, as shown in FIG. 6B, the elastic material 170' is applied onto the exposed longitudinal surface 158 of the substrate 150. In this state, the applied elastic material 170' has the acute contact angle α on one side away from the substrate 150. To this end, the liquid elastic material 170' is preferably selected from materials having a contact angle α against the plate 198. The liquid elastic material 170' then flows up on the exposed surface 158 to form the thin elastic layer due to the surface tension of the liquid. The substrate 150 with the elastic material is maintained for a certain time while maintaining the state shown in FIG. 6B to solidify the elastic material, forming the elastic layer 170 as shown in FIG. 4.

Although the deformed substrate 150 is moved on the plate 198 at the application of the elastic material 170' onto the longitudinal surface 158, the plate 198 may be moved instead while maintaining the substrate 150 unmoved.

The elastic layer 170 may be formed in different ways. For example, according to the alternative method, the liquid elastic material 170' is applied on the surface 158 of the substrate 150. This can be done by contacting the surface 158 to the liquid elastic material 170'. Then, the longitudinal corner edge 180 is forcedly brought into contact with the plate 198 so as to form the ramp 192. This causes the liquid material on the contact portion of the surface 158 to be removed therefrom, as shown in FIG. 6B. The remaining elastic material 170' is then solidified to form the stable elastic layer 170.

Although the plate 198 is used in the previous embodiments, it may be replaced by a roller having a smooth peripheral surface.

Once the cleaning member is released from the plate 198, unlike the elastic layer 170 shown in FIG. 3, the formed sub-portion 182 of the elastic layer 170 may have a thickness slightly greater or smaller than the major portion of the elastic layer. Also, the released corner edge 184 may have a certain angle greater or less than 90 degrees. It should be noted that the cleaning member with those configurations is also within the scope of the present invention. In other words, it should be understood that the cleaning member falls within the scope of the present invention provided that, when forced onto the image bearing member, it is capable of forming ramps with acute internal angles on the upstream and downstream sides with respect to the movement of the image bearing member.

The cleaning member so manufactured ensures that the ramp with the acute internal angle on the upstream side attains a stable and effective scraping of the toner particles from the image bearing surface, irrespective of the types of the toner and/or the amount of toner to be employed for the image formation.

The ramp 194 on the upstream side can be flipped over by the temporally increased frictional force against the image bearing member or the toner particles and then drawn into between the substrate and the image bearing member as shown in FIG. 5. The flipped portion can be returned into the normal state to recover the ramp 194 simply by moving the contacting image bearing surface in the backward direction. In the recovering operation, the image bearing member is preferably moved back and forth alternately by changing the rotation of the drum 12/the belt 20 on the basis of instruction from the drive control 114,124. Also, in this operation, the image bearing member is preferably moved back 10 mm or more, for example.

The foregoing description of the invention is merely exemplary in nature and, thus, variations that do not depart from the gist of the invention are intended to be within the scope of the invention. Such variations are not to be regarded as a departure from the spirit and scope of the invention.

For example, although the substrate and the elastic layer of the cleaning member are made of different materials in the previous embodiment, they may be made of the same material.

What is claimed is:

1. A cleaning member, elastically forced on a bearing surface, for cleaning off particles from the bearing surface by a movement of the bearing surface relative to the cleaning member, comprising:

first and second portions capable of concurrently forming first and second ramps having first and second acute internal angles on upstream and downstream sides of a contact region with respect to a moving direction of the bearing surface, respectively, the contact region being defined between the cleaning member and the bearing surface when the cleaning member is forced on the bearing surface, and wherein the first acute internal angle is measured from an upstream-most edge of the contact region and the second acute internal angle is measured from a downstream-most edge of the contact region.

2. The cleaning member of claim 1, wherein the first portion and the second portion have first and second longitudinal edges extending perpendicular or substantially perpendicular to the moving direction of the bearing surface, respectively, the first and second longitudinal edges being capable of forming the first and second ramps when the cleaning member is forced on the bearing surface.

3. The cleaning member of claim 2, wherein the first portion has a smaller hardness than the second portion.

4. The cleaning member of claim 2, wherein the first portion has a smaller static friction coefficient to the bearing surface than the second portion.

5. An elastic cleaning member in the form of plate, elastically forced on a bearing surface, for cleaning off particles from the bearing surface with a movement of the bearing surface relative to the cleaning member, comprising:

first and second sub-members having first and second longitudinal edges, respectively, extending perpendicular or substantially perpendicular to a moving direction of the bearing surface, the first and second longitudinal edges capable of forming first and second ramps having first and second acute internal angles on upstream and downstream sides of a contact region with respect to the moving direction, respectively, the contact region being defined between the cleaning member and the bearing surface when the cleaning member is forced on the bearing surface, and wherein the first acute internal angle is measured from an upstream-most edge of the contact region and the second acute internal angle is measured from a downstream-most edge of the contact region.

6. The cleaning member of claim 5, wherein the first sub-member has a smaller hardness than the second sub-member.

7. The cleaning member of claim 5, wherein the first sub-member has a smaller static friction coefficient to the bearing surface than the second sub-member.

8. An image forming apparatus, comprising:

a rotatable image bearing member capable of bearing a toner image made of toner particles;

a transfer device which transfers the toner image from the image bearing member to a receiving medium; and a cleaning member which contacts on the image bearing member to scrape off untransferred toner particles from the image bearing member, the cleaning member having first and second ramps having first and second acute internal angles concurrently formed on upstream and downstream sides of a contact region between the image bearing member and the cleaning member with respect to a rotational direction of the image bearing member, respectively, and wherein the first acute internal angle is measured from an upstream-most edge of the contact region and the second acute internal angle is measured from a downstream-most edge of the contact region.

9. The image forming apparatus of claim 8, wherein the first ramp has a smaller hardness than the second ramp.

10. The image forming apparatus of claim 8, wherein the first ramp has a smaller static friction coefficient to the image bearing member than the second ramp.

11. The image forming apparatus of claim 8, further including a drive unit capable of rotating the image bearing member in opposite directions.

12. The image forming apparatus of claim 11, wherein the drive unit rotates the image bearing member in a forward direction in an image forming operation and in a backward direction in a non image-forming operation.

* * * * *

UNITED STATES PATENT AND TRADEMARK OFFICE

CERTIFICATE OF CORRECTION

PATENT NO. : 7,907,884 B2
APPLICATION NO. : 11/785104
DATED : March 15, 2011
INVENTOR(S) : Sayaka Morita It is certified that error appears in the above-identified patent and that said Letters Patent is hereby corrected as shown below:

On the front page:

Under (56) References Cited, "Other Publications" please add:

--Japanese Office Action mailed on May 20, 2008 directed towards counterpart foreign application no. 2006-112102--.

Signed and Sealed this
Third Day of May, 2011

David J. Kappos

David J. Kappos
*Director of the United States Patent and Trademark Office*